US007056401B2

(12) United States Patent
Galluzzi

(10) Patent No.: US 7,056,401 B2
(45) Date of Patent: Jun. 6, 2006

(54) PRIMING MIXTURE FOR CARTRIDGE PRIMERS FOR SMALL FIREARMS

(75) Inventor: Carlo Galluzzi, Lecco (IT)

(73) Assignee: Fiocchi Munizioni S.p.A. (IT)

( * ) Notice: Subject to any disclaimer, the term of this patent is extended or adjusted under 35 U.S.C. 154(b) by 0 days.

(21) Appl. No.: 10/365,788

(22) Filed: Feb. 14, 2003

(65) Prior Publication Data

US 2004/0025992 A1 Feb. 12, 2004

(30) Foreign Application Priority Data

Mar. 1, 2002 (IT) ..... MI2002A0418

(51) Int. Cl.
*C06B 25/04* (2006.01)

(52) U.S. Cl. ..... 149/105

(58) Field of Classification Search ..... 149/62, 149/63, 68

See application file for complete search history.

(56) References Cited

U.S. PATENT DOCUMENTS 3,920,575 A * 11/1975 Shiki et al. ..... 149/35
4,040,879 A * 8/1977 Nagatugi et al. ..... 149/18
4,497,251 A * 2/1985 Rucker ..... 102/202.6
4,963,201 A * 10/1990 Bjerke et al. ..... 149/62
5,162,606 A * 11/1992 Jacob ..... 102/301
5,466,315 A * 11/1995 Erickson et al. ..... 149/96
5,610,367 A * 3/1997 Erickson et al. ..... 149/35
5,831,208 A * 11/1998 Erickson ..... 149/68
5,993,577 A * 11/1999 Erickson et al. ..... 149/68
6,227,116 B1 * 5/2001 Dumenko ..... 102/275.3
6,544,363 B1 * 4/2003 Erickson ..... 149/63
6,620,267 B1 * 9/2003 Guindon et al. ..... 149/63

OTHER PUBLICATIONS

Hawley, "The Condensed Chemical Dictionary", 9th Edition, (1977) Van Nostrand Reinhold Company, New York, pp. 36, 212 and 213.*

Hawley, "The Condensed Chemical Dictionary", 9th Ed., (1977) Van Nostrand Reinhold Company, New York, pp. 83, 96, 115,371 and 372.*

Fiocchi: Type Primers With Reduced Environmental Impact—Military Scientific Institute, Materials and Explosives—Apr. 19, 2004.

* cited by examiner

*Primary Examiner*—John R. Hardee
(74) *Attorney, Agent, or Firm*—Shlesinger & Fitzsimmons

(57) ABSTRACT

A priming mixture comprises aluminium silicate as the sensitizer, advantageously in a percentage higher than 10%, not exceeding 30% and preferably included between 15% and 25%. Combined with said sensitizer, the-mixture may further comprises a potassium compound, preferably potassium nitrate.

13 Claims, No Drawings

PRIMING MIXTURE FOR CARTRIDGE PRIMERS FOR SMALL FIREARMS

BACKGROUND OF THE INVENTION

The present invention relates to an innovatory formulation of a priming mixture for cartridges for small firearms.

It is known that in cartridges a percussion primer is present which contains the so-called priming mixture firing the projectile propelling charge.

Formulation of the priming mixture is very important in order to achieve the desired stability and sensitivity features for the specific function.

As far as a short while ago in the priming mixture formulation heavy metals and compounds thereof were used which, due to their high toxicity, are presently considered increasingly less acceptable, although minimum amounts of same are concerned.

Therefore, attempts have been made since long to reduce the content of these compounds by proposing alternative formulations. It has been proposed for example to replace barium, antimony and lead compounds with zinc peroxide, copper oxide, manganese dioxide or tin oxide.

These alternative formulations however have disadvantages that do not make them quite satisfactory, due to their residual toxicity as well as to the high production cost and unstable features upon temperature variations and also due to their reduced ballistic efficacy. For example, zinc peroxide is expensive and can hardly be obtained in a pure state and also has a reduced sensitivity at low temperatures.

It is a general aim of the present invention to obviate the above mentioned drawbacks by providing a priming mixture having high ballistic, stability and sensitivity features although at the same time it does not contain heavy metals or other compounds that are unacceptable due to toxicity.

SUMMARY OF THE INVENTION

In view of the above aim, in accordance with the invention, a priming mixture has been conceived which comprises a sensitizer that does not belong to the heavy-metal category, characterised in that this sensitizer is aluminium silicate.

For better explaining the innovatory principles of the present invention and the advantages it offers over the known art, embodiments of priming mixtures applying the above principles will be described hereinafter.

DETAILED DESCRIPTION OF THE INVENTION

In accordance with the invention it has been surprisingly found that a priming mixture comprising a sensitizer consisting of aluminium silicate has the same sensitivity as that obtained by use of antimony sulphide, which is excellent in terms of technical characteristics but is no longer acceptable due to its toxicity.

In addition, its features keep steady upon temperature variations.

In particular, it was found advantageous for the aluminium silicate to be in a percentage higher than 10% but not exceeding 30% and preferably included between 15% and 25%.

Furthermore, combining use of a potassium compound in a percentage higher than 10% with use of aluminium silicate was found advantageous too. The preferred potassium compound is potassium nitrate, in a percentage higher than 25% and preferably higher than 30%. A particularly advantageous percentage range for the primer quality was found to be included between 30% and 50%.

Also advantageously, it was found preferable that the main primer explosive or charge should be diazodinitrophenol and the secondary one should be tetrazene.

In addition, use of a bonding agent such as nitrocellulose and an agent such as zirconium or pentaerythritol tetranitrate, each in an amount of at least 2%, appeared to be useful.

Two formulations of a mixture in accordance with the invention were found particularly advantageous for the characteristics of stability and sensitivity of the primer and are therefore set out hereinbelow as a non-limiting example.

The first formulation comprises:

| | | |
|---|---|---|
| diazodinitrophenol | 27% | ±5 |
| tetrazene | 6% | ±1 |
| potassium nitrate | 38% | ±5 |
| nitrocellulose | 3% | ±1 |
| aluminium silicate | 22% | ±4 |
| pentaerythritol tetranitrate | 3% | ±1 |

The second advantageous formulation comprises:

| | | |
|---|---|---|
| diazodinitrophenol | 27% | ±5 |
| tetrazene | 6% | ±1 |
| potassium nitrate | 36% | ±5 |
| nitrocellulose | 4% | ±1 |
| aluminium silicate | 20% | ±4 |
| zirconium | 5% | ±1.5 |

Surprisingly, mixtures in accordance with the invention have a ballistic efficacy comparable with, if not higher than, that of traditional priming mixtures based on lead styphnate with the same or even higher sensitivity. In addition, the mixtures of the invention have a particularly good functional character even at low temperatures and can be therefore used in ammunitions for military use as well, and not only in primers for target-shooting cartridges, in drills or the like, which on the contrary happens in most of the primer compositions of the "ecological" type.

At this point it is apparent that the intended purposes are reached.

Obviously, the above description of an embodiment applying the innovatory principles of the present invention is taken by way of example only and therefore must not be considered as a limitation of the patent rights herein claimed.

What is claimed is:

1. In a small firearms cartridge, a percussion primer priming mixture comprising:

at least one explosive, the at least one explosive including diazodinitrophenol as a primary explosive; and an amount of a sensitizer for the one or more explosives in the priming mixture;

wherein the sensitizer consists of aluminum silicate present in a percentage of at least 10% and the percussion primer priming mixture is free of sensitizers belonging to the heavy-metal category.

2. The priming mixture as claimed in claim 1, wherein the aluminum silicate is present in a percentage between 10% and 30%.

3. The priming mixture as claimed in claim 1, further comprising:

a potassium compound in a percentage higher than 10%.

4. The priming mixture as claimed in claim 3, wherein the potassium compound is potassium nitrate.

5. The priming mixture as claimed in claim 4, wherein the potassium nitrate is present in a percentage higher than 25%.

6. The priming mixture as claimed in claim 5, wherein the potassium nitrate is present in a percentage between 30% and 50%.

7. The priming mixture as claimed in claim 1, wherein the at least one explosive comprises tetrazene as a secondary explosive.

8. The priming mixture as claimed in claim 1, further comprising:

nitrocellulose, present in an amount of at least 2%; and pentaerythritol tetranitrate present in an amount of at least 2%.

9. A priming mixture for percussion primers to be used in cartridges for small firearms, the priming mixture comprising:

| | | |
|---|---|---|
| diazodinitrophenol | 27% | ±5 |
| tetrazene | 6% | ±1 |
| potassium nitrate | 38% | ±5 |
| nitrocellulose | 3% | ±1 |
| aluminium silicate | 22% | ±4 |
| pentaerythritol tetranitrate | 3% | ±1. |

10. A priming mixture for percussion primers to be used in cartridges for small firearms, the priming mixture comprising:

| | | |
|---|---|---|
| diazodinitrophenol | 27% | ±5 |
| tetrazene | 6% | ±1 |
| potassium nitrate | 36% | ±5 |
| nitrocellulose | 4% | ±1 |
| aluminium silicate | 20% | ±4 |
| zirconium | 5% | ±1.5. |

11. The priming mixture as claimed in claim 1, wherein the aluminum silicate is present in a percentage between 15% and 25%.

12. In a small firearms cartridge, a percussion primer priming mixture comprising:

at least one explosive, the at least one explosive including diazodinitrophenol as a primary explosive; and only one sensitizer consisting of aluminum silicate present in a percentage of at least 10%;

the percussion primer priming mixture being free of other sensitizers.

13. A small firearms cartridge percussion primer priming mixture formulation method comprising providing at least one explosive and providing only one sensitizer, providing only one sensitizer including providing at least 10% aluminum silicate in the mixture, the at least one explosive including diazodinitrophenol as a primary explosive.

* * * * *